United States Patent [19]

Jorquera

[11] Patent Number: 4,848,750

[45] Date of Patent: Jul. 18, 1989

[54] METHOD FOR CONSTRUCTING AND REPAIRING METALLURGICAL CONVERTERS

[75] Inventor: Luis T. Jorquera, Machalí, Rancagua, Chile

[73] Assignee: Corporacion Nacional del Corbe de Chile, Santiago, Chile

[21] Appl. No.: 289,480

[22] Filed: Dec. 21, 1988

Related U.S. Application Data

[63] Continuation-in-part of Ser. No. 886,766, Jul. 16, 1986, abandoned, which is a continuation-in-part of Ser. No. 661,042, Oct. 15, 1984, abandoned.

[51] Int. Cl.[4] ..... C22B 1/00

[52] U.S. Cl. ..... 266/44; 266/280; 264/30

[58] Field of Search ..... 266/44, 280, 281, 286, 266/270, 265, 268; 264/30

[56] References Cited

U.S. PATENT DOCUMENTS

| | | | |
|---|---|---|---|
| 870,925 | 11/1907 | Baggaley | 266/270 |
| 942,661 | 12/1909 | Peirce | 266/270 |
| 1,284,880 | 11/1918 | Ely | 266/286 |
| 2,599,158 | 6/1952 | Brassert | 266/248 |
| 2,826,405 | 3/1958 | McFeaters | 266/286 |

FOREIGN PATENT DOCUMENTS

| | | | |
|---|---|---|---|
| 1391775 | 4/1975 | United Kingdom | 266/286 |

*Primary Examiner*—S. Kastler

*Attorney, Agent, or Firm*—Pennie & Edmonds

[57] ABSTRACT

A modified metallurgical converter wherein removable segments or portions are provided in the anticipated areas of highest wear of its refractory lining, and methods for repairing same. Also, a method for improving the service and operational life of such metallurgical converters.

10 Claims, 2 Drawing Sheets

METHOD FOR CONSTRUCTING AND REPAIRING METALLURGICAL CONVERTERS

This application is a continuation-in-part of application Ser. No. 886,766, filed July 16, 1986, abandoned, which is a continuation-in-part of application Ser. No. 661,042, filed Oct. 15, 1984, abandoned.

TECHNICAL FIELD

The present invention relates to metallurgical converters and more specifically, to modified metallurgical converters which provide easy access for the repair of its internal refractory lining.

BACKGROUND ART

A number of metallurgical converters for copper, nickel, lead or other nonferrous ores or the like, are well known in the mining art. These converters generally include those known as Peirce-Smith, Teniente, Noranda, or other similar types.

The converters which are most commonly used are basically characterized as having a cylindrical horizontal shell which can be of variable dimensions depending upon the specific production requirements. The material of construction for the shell is generally carbon steel lined with a refractory material in order to allow the converter to operate properly in contact with liquid metallic elements at temperatures of approximately 1200° C. and above.

The converter is used to oxidize various components of the ores. For example, in the conversion of copper mattes, air is introduced through molten copper matte to oxidize any metal sulfides which are present. This oxidation is accomplished by injecting an oxidizing agent, most commonly air, into the molten ore bath in the converter through tuyeres which extend through the shell and refractory lining. These tuyeres are located in a predetermined arrangement usually in the bottom or lower portion of the converter shell.

During the course of operation of the converter over an extended time period, the refractory lining begins to wear or deteriorate. Usually, the refractory areas adjacent to and around the tuyeres experience the greatest wear because of the turbulence from the introduction of the air and the localized heating caused by the reaction of the air with the ore components. Also, the refractory lining can spall, crack or flake if subjected to extreme temperature fluctuations. Therefore, it becomes necessary to shut down the equipment and repair or replace the damaged refractory lining.

Previously, the usual method of repair would be to stop the operation of the converter, allow it to cool to ambient temperatures, remove the heads to facilitate entry into the shell, and replace the damaged or deteriorated portions of the refractory lining. The repair or replacement of the refractory lining is difficult and time consuming since maintenance personnel would have to work within the converter shell itself. In addition, the reliability of a refractory lining is suspect in the areas where the new or replacement lining must be joined or bonded to the remaining portions of the original lining. For this reason, it is often preferable to replace the entire refractory lining of the vessel in order to achieve longer service lives and more reliable operation when the converter is put back on stream.

Furthermore, the loss of production due to the removal of the converter from service for a considerable length of time and the repair cost (i.e. materials and labor) for installing the replacement refractory lining are relatively high. Therefore, the mining industry has long been searching for an alternative method of reliably repairing or maintaining these converters to avoid such long down time periods and high repair costs.

BRIEF DESCRIPTION OF THE INVENTION

The applicant has discovered that modifying the steel shell of the converter by installing easily removable shell portions or segments in the areas which are expected to receive the most severe service, such as the tuyere zones, permits access to the refractory material which lines the interior of the converter shell in this zone and facilitates the repair and/or replacement thereof. The modified converter of the invention and the method for its repair represent numerous advantages due to the shorter repair time involved, which in turn means greater operating availability and greater associated productivity; conservation of repair material and labor costs; more convenient working conditions for maintenance personnel; and more reliable operation of the converter when it is returned to service.

SUMMARY OF THE INVENTION

The present invention relates to an improved metallurgical converter having a cylindrical shell which is lined with a refractory material wherein the shell of the converter is modified by providing a plurality of removable segments or portions in the areas where the greatest degree of lining deterioration is anticipated. The refractory material which is used to line the shell does not adhere to the removable segments. Therefore, only the damaged or deteriorated portions of the lining need to be repaired, not the entire lining that is located adjacent the segmented portions. Each segment is connected to the remainder of the shell by a flange and bolt assembly to facilitate its removal and replacement. Furthermore the removal of each segment is effected from the outside of the converter.

Another aspect of this modified metallurgical converter relates to the modification of the shell to provide a plurality of removable segmented portions around the tuyere area. Again, each segment is connected to the remainder of the shell by a flange and bolt assembly to facilitate their removal and replacement, and each segment can preferably be removed or replaced from the outside of the converter. As above, the refractory lining does not adhere to the removable segments to facilitate repair of only the damaged or deteriorated areas of the lining rather than of the entire lining behind the segmented shell portions.

Another aspect of the invention relates to the improvement of the shell of a metallurgical converter wherein a plurality of segmented portions are provided in the zones of most frequent repair. These segmented portions have connection means to facilitate easy attachment to and removal from the remaining portion of the converter shell. Preferably, the connection means comprises a flange along the longitudinal edges of the segmented portions and a corresponding mating flange on the longitudinal edges of the remaining portion of the shell. Also, the flanges of the segmented and remaining portions are advantageously joined by bolting means.

Another embodiment of the invention relates to a method for repairing deteriorated refractory portions of a modified metallurgical converter as described herein-above which comprises stopping the operation of the converter; removing the segmented portion from the area exterior to damaged or deteriorated portions of the refractory lining without cooling the converter from its operating temperatures; repairing the damaged or deteriorated portions of the lining behind the removed segments; and reattaching the segments to the converter shell.

Another method of the invention relates to the repair of damaged or deteriorated areas of the refractory lining of a metallurgical converter wherein the portions or segments of the converter shell which are anticipated to experience the greatest wear are configured, dimensioned, and positioned to facilitate easy removal for repair or replacement of the damaged portions of the refractory lining of the interior surface of the shell. These segments can be removed and replaced to facilitate the repair or replacement of damaged or deteriorated liner sections without the necessity of cooling the converter to ambient temperatures, because this operation can be performed from the outside of the converter.

Also disclosed herein is a specific method for repairing the deteriorated refractory lining in the vicinity of the tuyeres of a metallurgical converter wherein portions or segments of the shell encompassing the tuyeres and adjacent areas where wear of the refractory lining is anticipated, are configured, dimensioned and positioned to facilitate easy removal of the portions or segments in that area so as to facilitate the repair and/or replacement of the liner within the converter shell without having to cool the converter to ambient temperatures.

A further embodiment of the invention relates to a method for extending the service life of a metallurgical converter which comprises modifying the converter by installing easily removable portions or segments in the shell over those areas of the liner which are expected to experience the highest wear or use during operation.

Further benefits and advantages of the invention will become apparent from a consideration of the following description given with reference to the accompanying drawing figures which specify and show preferred embodiments of the present invention.

DETAILED DESCRIPTION OF THE PREFERRED EMBODIMENTS

The pyrometallurgical processes used for the production of copper from copper sulfide concentrates comprises the stages of smelting followed by converting. The first stage is ordinarily carried out in a static furnace, the most common of which is a reverberatory furnace, such as an Outokumpu or INCO flash furnace. The conversion process is usually carried out in Peirce-Smith horizontal converters. Other modern processes, such as those used by Noranda and El Teniente, use converters that completely or at least partially combine these two stages.

Figure 1:
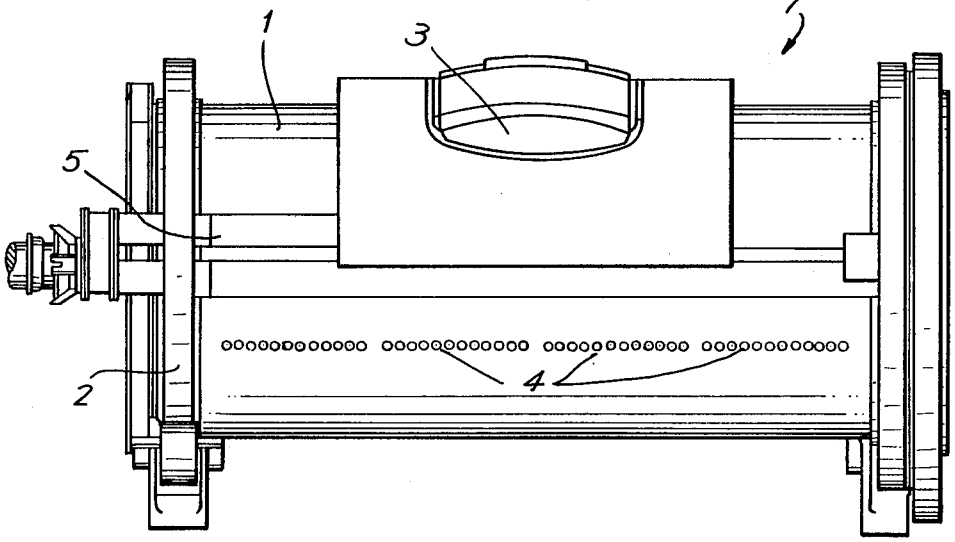
FIG. 1 is a front view of a prior art converter unit.
Figure 2:
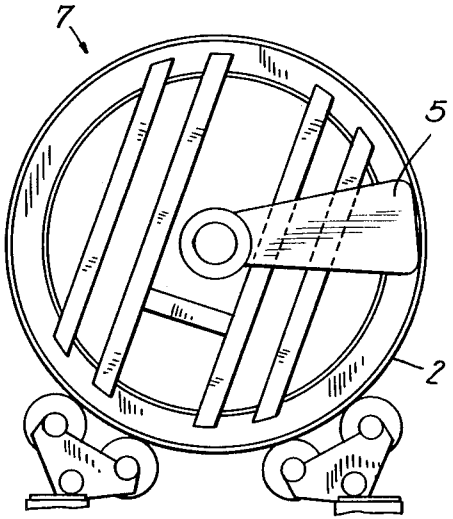
FIG. 2 is a side view of the converter of FIG. 1.

A common characteristic of the above-mentioned processes is the use of the horizontal Peirce-Smith converter furnace as the main equipment item for producing blister copper. A typical prior art converter is shown in FIGS. 1 and 2. This converter 7 consists of a metal cylinder 1 having means for rotary motion 2. The cylinder or shell 1 is lined with a refractory material (not shown) and has an outlet 3 for the discharge of gases.

The oxidizing gas, which is used to promote reactions in the converter, is injected through tuyeres 4, which are tubular openings of approximately 2 inches in diameter, made horizontally or at a slight angle along at least part and preferably the entire length of the shell at a given location. These tuyere openings are usually located under the central shaft of the converter when the latter is in its operating position. This arrangement is illustrated in Fig. 1. The tuyeres introduce the oxidizing gas from a gas distributing system to the molten metal bath in the shell. In the conversion of copper matte, the bath contains copper sulfide and molten copper. Thus, special steel tubes of approximately 2 inches (inner diameter), suitably connected to an air distributing system 5, are inserted into openings made through the refractory metal lining.

The refractory lining is selected based on the particular requirements of the type of operation carried out in the converter. Over time, this lining undergoes gradual deterioration which is reflected in wear of the refractory lining. Over the course of its service life, the thickness of the lining is reduced to a limit that impairs the strength of the shell and the operating efficiency of the converter. At that time, the equipment has to be shut down in order to undergo an overhaul, which primarily includes replacement of the worn portions of the refractory lining which might jeopardize the continuous operation of the unit when returned to service. The time normally employed in carrying out this overhaul, calculated from the time when the equipment stops operating until it is returned to service, is 12 to 20 hours, depending on the type of converter. This period includes the time necessary to cool the unit to ambient temperatures as well as to reheat the unit to working temperatures. This downtime represents a significant loss of production capacity.

The present mode of operation of these converters causes the greatest wear of the refractory lining in the areas surrounding the tuyeres and the zones adjacent thereto. The wear in these areas determines when the converter must be removed from operation for repair of the refractory lining. Since the repair of the refractory lining necessitates cooling of the converter to ambient temperatures; this, in turn, detrimentally affects the useful life of the unworn portions of the refractory lining, which requires more frequent future repairs. Thus, the reliability of the convertor is reduced and maintenance costs are increased.

In order to increase the availability and reliability of this equipment, the applicant has discovered a way to modify the shell of the converter which then makes it possible to completely replace the worn portions of the refractory lining from the outside of the converter without having to cool the unit to room temperature. Usually, the portions of the refractory lining which experience the greatest wear occurs around the tuyeres.

Figure 4:
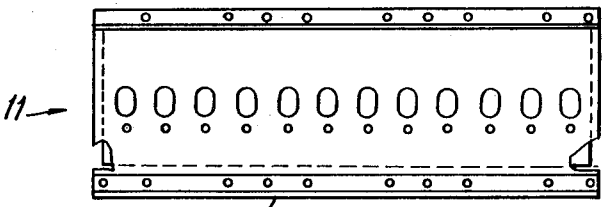
FIG. 4 is a detail of a removable section of the shell of the converter of FIG. 3.
Figure 5:
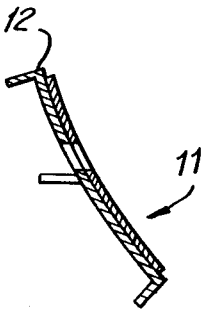
FIG. 5 is a side view of the removable shell section of FIG. 4.
Figure 3:
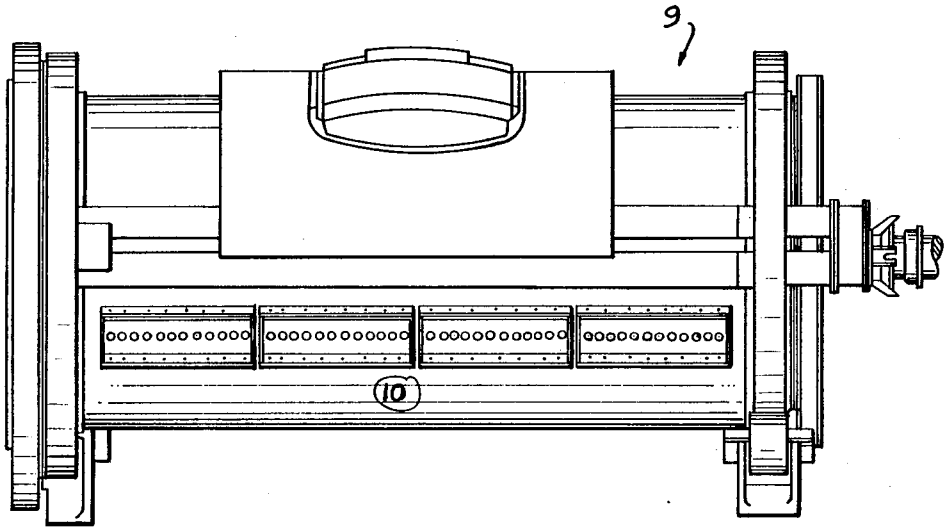
FIG. 3 is a front view of a converter unit according to the present invention.

A preferred embodiment of the present invention consists of a metallurgical converter as shown in FIGS. 3–5. This modification is based on the provision of a segmented converter shell in the tuyere zone 10. By making each segment 11 easily removable, access to the refractory lining on the interior of the converter shell in this zone is facilitated. Since the lining is not attached to the segments 11, only those portions of the lining 12 which have been damaged or have deteriorated can be replaced, while the remaining unaffected lining behind the removed shell segments remains intact. Therefore, workers can easily repair these relatively small damaged areas without first cooling the converter to ambient temperature, since the deteriorated area of the lining or the aperture 13 provided therein for the tuyeres are the only openings into the hot core of the converter. This also allows the segmented shell portions 11 to be reused.

The steel shell of the converter is modified by installing easily removable shell portions or segments in the areas which are expected to receive the most severe service, such as the tuyere zones. This permits access to the refractory material which lines, but which is not connected to, the interior of the converter shell in this zone and facilitates the repair and/or replacement thereof. The method of constructing the modified converter of this invention and the method for its repair represent numerous advantages due to the shorter repair time involved, which in turn means greater operating availability and greater associated productivity; conservation of repair material and labor costs; more convenient working conditions for maintenance personnel; and more reliable operation when it is returned to service.

These methods for constructing and repairing metallurgical converters have not been previously used by others in the field of non-ferrous ore conversion. This is due to the fact that the necessary computer technology, which makes it possible to calculate the exact amount of shell reinforcement neceded and the most efficient arrangement of the flange and bolt assembly on the removable segmented portions of the converter shell, has only recently been utilized for the design of such modified equipment.

This preliminary development of computer models for the modified converter is necessary in order to ensure that the apparatus will not be damaged or deformed during its operation due to splitting, breaking or leaking. Without the use of preliminary computer models to assist in developing the design of the converter, there is a high risk that the apparatus will fail to perform in a satisfactory manner.

The "necessary computer technology" refers to a non-linear, thermal relaxed, elasto-plastic model, using finite element technique to predict the behavior of a converter vessel under mechanical and thermal loads. This type of computer model has been used in structural analysis for two or three decades, but its application to the design of converter vessels is only recent.

A basic description of the model is presented below:

the shell is represented by plate-shell elements of quadliteral shape having 4 nodes and 5 degrees of freedom per node. The thickness of each zone is carefully considered in order to detect the occurrence of stress risers.

the zone of tuyere ports is reinforced by beam elements according to design experience.

the deformation of the shell is represented by modal points, translations and rotations.

at each shell finite element, membrane stress, flexural stress, and torsional stress values are obtained from the finite element analysis. The total stress is obtained by superposition of these stresses.

the output of the basic finite element analysis is:

listing file of nodal displacements and rotation unformatted file of nodal displacement and rotations unformatted file of membrane, flexural and torsional stresses.

a post-processor reads these files and performs the evaluation of total stresses. The complete state of stress at each element is evaluated, including principal stresses and Von Mises stresses for internal and external surfaces of the shell.

the post-processor generates underformed and deformed mesh computer graphics and stress plots for any arbitrary section.

the final design is attained after an interactive process from preliminary design, computer evaluation, modifications and detail design engineering.

Each segmented section 11 of the shell 1 includes a given number of tuyeres 4. An inner layer of refractory or brick material 12 lines the interior of the converter shell 1. The amount of brick or refractory reinforcement in this area depends upon the anticipated type and degree of wear in that zone. The length of the segments 11 depends upon the length of the equipment, the number of tuyeres 4 required by the converter and the facilities available at the plant for removing the segmented sections 11 so as to provide access for replacement and/or repair to the underlying refractory lining of the converter shell.

These segments 11 consist of equal portions of rectangular shapes which follow the curvature of the shell 1 and to which the lining 12 is not attached. A plurality of apertures 13 for the installation of tuyeres 4 are provided through both the segmented shell portion 11 as well as the separate refractory layer 12 underlying the segmented shell sections 11.

The remaining portions of the shell 1 and the segments 11 have, on their longitudinal edges, flanges 14, projecting toward the outside of the converter to serve as bolting unions. These flanges 14 serve to facilitate the joining of the segments 11 to the shell 1 by bolts (not shown) without the converter loosing any mechanical strength compared to an integral (i.e. non-segmented) converter unit.

The principal operations carried out in the preferred repair of the refractory material of the tuyere zone in the modified converters of the present invention is as follows:

(a) stop operation of the converter, without cooling the unit from its working temperature;

(b) disconnect the tubes of the air distributing system;

(c) loosen the bolts which connect the flanges of the segments and shell;

(d) remove the segments from the outside to gain access to the refractory lining;

(e) replace the deteriorated areas of the refractory lining behind segments;

(f) replace and reattach the segments to the shells; and (g) reconnect the air distributing system to the tuyeres.

This modification in design and simple procedure for repair of the metallurgical converters of the present invention, is applicable to many types of converters in the metals industry, preferably for the conversion of nonferrous metals such as copper, nickel, lead and the like. This simple system presents significant advantages over the traditional repair procedures for this equipment, including:

(1) increasing the availability of the converter by appreciably reducing the repair time, which allows greater productivity of the equipment;
(2) reducing the cost of future repairs and increasing the reliability and useful life of the undeteriorated portions of the refractory lining of the converter by the detrimental effect caused by because only the damaged portions are repaired, and cooling to ambient temperatures is avoided;
(3) improving and simplifying the working conditions for repair and maintenance personnel; and
(4) applying this procedure to any portion of the shell that may require more frequent repair of the refractory lining positioned below a removable segmented portion of the shell.

While it is apparent that the invention herein disclosed is well calculated to fulfill the desired results, it will be appreciated that numerous modifications and embodiments may be devised by those skilled in the art, and it is intended that the appended claims cover all such modifications and embodiments as fall without the true spirit and scope of the present invention.

Having thus described the invention, what is claimed is:

1. A method of making an apparatus for converting non-ferrous ore which comprises:
constructing a cylindrical shell;
lining the shell with a refractory material to protect the shell from the effects of molten ore; and
modifying the shell of the apparatus by providing a plurality of removable segmented portions consisting essentially of a generally arcuate reinforcing plate containing a plurality of openings for the attachment of tuyeres utilized for the introduction of an oxidizing agent and having connection means to facilitate attachment to and removal from the shell, said refractory material not being attached to said segmented portions of the shell.

2. The method according to claim 17 which further comprises connected each segmented portion to the shell of the converter by connection means comprising flange means and bolting means to facilitate the removal and replacement of said segments in order to obtain access to said refractory lining.

3. The method according to claim 2 which further comprises removing or replacing a portion of the refractory lining which becomes damaged or deteriorated from the outside of the converter after said segmented portion is removed.

4. A method for repairing portions of a damaged or deteriorated refractory lining in an apparatus for converting non-ferrous ore which comprises:
constructing an apparatus by the method of claim 1;
terminating the converting operation of the apparatus;
detaching and removing the segmenting portions from the shell of the apparatus in the vicinity of the damaged or deteriorated refractory lining;
removing the damaged or deteriorated refractory lining;
installing a new refractory lining where the damaged or deteriorated refractory lining has been removed; and
relocating the segmented shell portions to the shell of the apparatus.

5. The method according to claim 4 wherein the damaged or deteriorated refractory lining is replaced without cooling the apparatus to ambient temperature.

6. The method according to claim 4 wherein the damaged refractory lining is replaced from outside the shell of the apparatus after said segmented portions are removed.

7. A method for repairing portions of a damaged or deteriorated refractory lining in an apparatus for converting non-ferrous ore which comprises:
constructing an apparatus by the method of claim 1;
terminating the converting operation without cooling the apparatus to ambient temperature;
detaching and removing the segmented portions from the apparatus in the vicinity of the damaged or deteriorated refractory lining;
repairing or replacing the damaged or deteriorated refractory lining from outside the shell of the apparatus; and
reattaching the segmented shell portions to the shell of the apparatus.

8. In a method for making an apparatus for converting non-ferrous ore, said apparatus comprising a shell having an interior lining of a refractory material, the improvement which comprises modifying the shell of the apparatus by providing a plurality of removable segmented portions consisting of plate means containing a plurality of openings for the attachment of tuyeres and means for removable attachment to the shell of the apparatus.

9. A method for repairing portions of a damaged or deteriorated refractory lining in an apparatus for converting non-ferrous ore which comprises:
constructing an apparatus by the method of claim 8;
terminating the converting operation of the apparatus;
detaching and removing the segmented portions from the shell of the apparatus in the vicinity of the damaged or deteriorated refractory lining;
removing the damaged or deteriorated refractory lining behind the removed shell segmented portions;
installing a new refractory lining where the damaged or deteriorated refractory lining has been removed; and
relocating the segmented shell portions to the shell of the apparatus.

10. A method for repairing portions of a damaged or deteriorated refractory lining in an apparatus for converting non-ferrous ore which comprises:
constructing an apparatus by the method of claim 8;
terminating the converting operation without cooling the apparatus to ambient temperature;
detaching and removing the segmented portions from the apparatus in the vicinity of the damaged or deteriorated refractory lining;
repairing or replacing the damaged or deteriorated refractory lining behind the removed shell segmented portions from outside the shell of the apparatus; and
reattaching the segmented shell portions to the shell of the apparatus.

* * * * *

UNITED STATES PATENT AND TRADEMARK OFFICE

CERTIFICATE OF CORRECTION

PATENT NO. : 4,848,750

DATED : July 18, 1989

INVENTOR(S) : Luis T. Jorquera

It is certified that error appears in the above-identified patent and that said Letters Patent is hereby corrected as shown below:

Title Page

Item [73]: the correct name of the assignee is: Corporacion Nacional del Cobre de Chile Col. 4, line 40: "hours" should be --days--.

Col. 7, line 55 (claim 4, line 4): after "claim 1" change ";" to --, which permits after--.

Col. 8, line 36 (claim 9, line 4): after "claim 8" change ";" to --, which permits after--.

Signed and Sealed this

Twenty-fourth Day of July, 1990

*Attest:*

HARRY F. MANBECK, JR.

*Attesting Officer*

*Commissioner of Patents and Trademarks*